US009912090B2

(12) United States Patent
Yokota et al.

(10) Patent No.: US 9,912,090 B2
(45) Date of Patent: Mar. 6, 2018

(54) PRESSURE CONTACT TYPE CONNECTOR AND MANUFACTURING METHOD OF THE SAME

(71) Applicant: ALPS ELECTRIC CO., LTD., Ota-ku, Tokyo (JP)

(72) Inventors: Junichiro Yokota, Tokyo (JP); Takashi Kawahata, Tokyo (JP); Rikiya Suzuki, Tokyo (JP); Seiichiro Sato, Tokyo (JP); Shuji Omura, Tokyo (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/719,986

(22) Filed: May 22, 2015

(65) Prior Publication Data

US 2015/0340789 A1 Nov. 26, 2015

(30) Foreign Application Priority Data

May 23, 2014 (JP) ..... 2014-107561
Aug. 28, 2014 (JP) ..... 2014-173577

(51) Int. Cl.
*H01R 4/48* (2006.01)
*H01R 13/24* (2006.01)
*H01R 43/16* (2006.01)

(52) U.S. Cl.
CPC ..... *H01R 13/2407* (2013.01); *H01R 43/16* (2013.01); *Y10T 29/49206* (2015.01)

(58) Field of Classification Search
CPC ..... H01R 9/09; H01R 13/2407; H01R 43/16; H01R 12/73
USPC ..... 439/816, 66, 245, 81, 862
See application file for complete search history.

(56) References Cited

U.S. PATENT DOCUMENTS 4,652,075 A * 3/1987 Billette de Villemeur ..... H01R 24/20 439/840
5,184,962 A * 2/1993 Noschese ..... H01R 12/714 439/591
5,655,913 A * 8/1997 Castaneda ..... H01R 12/57 439/66

(Continued)

FOREIGN PATENT DOCUMENTS

JP 2010-118256 5/2010
JP 2010118256 A * 5/2010
JP 2014-071964 4/2014

*Primary Examiner* — Abdullah Riyami
*Assistant Examiner* — Nader Alhawamdeh
(74) *Attorney, Agent, or Firm* — Hunton & Williams LLP

(57) ABSTRACT

A pressure contact type connector includes: an upper flat plate portion; a lower flat plate portion which is disposed below the upper flat plate portion; a first spring portion which connects the upper and lower flat plate portions; and a second spring portion which extends upward from the lower flat plate portion and applies a resilient force to the upper flat plate portion, in which the first and second spring portions are wound about the upper flat plate portion when viewed from above in a plan view, and extend so that the spring portions do not interfere with each other when being compressed and extended in the vertical direction, the first spring portion is formed to be bent so that a width dimension is larger than a thickness dimension, and the second spring portion is formed to be bent so that a width dimension is larger than a thickness dimension.

12 Claims, 13 Drawing Sheets

(56) References Cited

U.S. PATENT DOCUMENTS

| | | | | |
|---|---|---|---|---|
| 7,393,214 | B2 | 7/2008 | DiStefano | |
| 7,938,697 | B2 * | 5/2011 | Inaba | H01R 13/2407 439/289 |
| 8,162,673 | B2 * | 4/2012 | Chen | H05K 9/0064 439/66 |
| 8,926,338 | B2 * | 1/2015 | Kiryu | H01R 13/2442 439/66 |
| 2006/0046533 | A1 * | 3/2006 | Okamoto | H01R 13/2407 439/74 |
| 2008/0297183 | A1 | 12/2008 | Yamamura et al. | |
| 2011/0177718 | A1 * | 7/2011 | Shen | H01R 13/2492 439/625 |
| 2011/0177725 | A1 * | 7/2011 | Koyama | H01R 13/2428 439/759 |
| 2012/0171909 | A1 * | 7/2012 | Harada | H01R 12/57 439/862 |
| 2014/0087605 | A1 * | 3/2014 | Kiryu | H01R 13/2442 439/884 |
| 2014/0308825 | A1 * | 10/2014 | Hashiguchi | H01R 13/24 439/66 |
| 2015/0111400 | A1 * | 4/2015 | Hashiguchi | H01R 12/714 439/66 |
| 2016/0164235 | A1 * | 6/2016 | Aporius | H01R 12/7088 439/122 |

* cited by examiner

PRESSURE CONTACT TYPE CONNECTOR AND MANUFACTURING METHOD OF THE SAME

CLAIM OF PRIORITY

This application contains subject matter related to and claims the benefit of Japanese Patent Application No. 2014-107561 filed on May 23, 2014 and Japanese Patent Application No. 2014-173577 filed on Aug. 28, 2014, the entire contents of which are incorporated herein by reference.

BACKGROUND OF THE DISCLOSURE

1. Field of the Disclosure

The present disclosure relates to a pressure contact type connector, and particularly, to a pressure contact type connector in which a connection terminal is formed in a spiral shape.

2. Description of the Related Art

In recent years, as means for electrically connecting different substrates housed in an electronic device, use of a structure has increased, in which a pressure contact type connector including a connection terminal having elasticity is provided on one substrate, a contact portion is provided on the other substrate, and the substrates are disposed so that the contact portion and the pressure contact type connector come into pressure-contact with each other. In the pressure contact type connector, the connection terminal is formed in a spiral shape so as to have elasticity. As the pressure contact type connector in which the connection terminal is formed in a spiral shape, a pressure contact type connector disclosed in Japanese Unexamined Patent Application Publication No. 2010-118256 has been known.

Hereinafter, the pressure contact type connector disclosed in Japanese Unexamined Patent Application Publication No. 2010-118256 will be described with reference to FIGS. 13A and 13B. FIGS. 13A and 13B are views showing a structure of a connection terminal 902 of a pressure contact type connector 900, FIG. 13A is a plan view showing an outline of the connection terminal 902, and FIG. 13B is a sectional view showing a section taken along line Z-Z shown in FIG. 13A.

In the pressure contact type connector 900 disclosed in Japanese Unexamined Patent Application Publication No. 2010-118256, the spiral contactor (connector terminal) 902 is spirally formed from the base 902*b* toward the center of the tip, and includes a tip 902*a* at the center of the spiral. In addition, the spiral contactor 902 includes a groove 902*d* formed along a longitudinal direction of the spiral contactor 902 at the center in the width direction of the spiral contactor 902, the center is formed in a planar shape or a convex shape, and the spiral contactor 902 includes a protrusion 902*aa* on the upper surface of the tip 902*a*.

In recent years, as a pressure contact type connector, a pressure contact type connector having a mounting area of 2 mm×2 mm or less has been required. However, in the pressure contact type connector 900 disclosed in Japanese Unexamined Patent Application Publication No. 2010-118256, since the spiral contactor 902 is double-spirally formed, it is difficult to decrease a mounting area of the connector. In addition, even when the mounting area decreases by reducing the width of the spiral contactor 902, there is a concern that an elastic force sufficient for obtaining electrically stable connection cannot be obtained.

These and other drawbacks exist.

SUMMARY OF THE DISCLOSURE

Embodiments of the present disclosure provide a pressure contact type connector capable of having a reduced mounting area and obtaining a large elastic force.

According to an aspect, a pressure contact type connector includes: an upper flat plate portion which extends in a flat plate shape along a horizontal direction; a lower flat plate portion which extends in a flat plate shape along a horizontal direction and is disposed below the upper flat plate portion; a first spring portion which connects one end portion of the upper flat plate portion and one end portion of the lower flat plate portion and has elasticity in a vertical direction; and a second spring portion which is connected to at least one of the other end portion of the upper flat plate portion opposing the one end portion of the upper flat plate portion while interposing the upper flat plate portion and the other end portion of the lower flat plate portion opposing the one end portion of the lower flat plate portion while interposing the lower flat plate portion, extends toward the other ends of the upper flat plate portion and the lower flat plate portion, includes elasticity in the vertical direction, and is configured to apply a resilient force to the upper flat plate portion, in which the first spring portion and the second spring portion are wound in the same direction about the upper flat plate portion when viewed from above in a plan view, and extend so that the first spring portion and the second spring portion do not interfere with each other when the spring portions are compressed and extended in the vertical direction, the first spring portion is formed so as to be bent with respect to the upper flat plate portion and the lower flat plate portion so that a width dimension in the vertical direction is larger than a thickness dimension in the horizontal direction, and the second spring portion is formed so as to be bent with respect to at least one of the upper flat plate portion and the lower flat plate portion so that a width dimension in the vertical direction is larger than a thickness dimension in the horizontal direction.

Accordingly, the first spring portion and the second spring portion are formed so that a thickness direction of the first spring portion and a thickness direction of the second spring portion are the horizontal directions, and thus, a reduction in a size of the pressure contact type connector in the horizontal direction is achieved. In addition, when viewed from the side, since it is possible to increase width dimensions of the first spring portion and the second spring portion with respect to the directions in which the first spring portion and the second spring portion are wound, it is possible to obtain a large elastic force. Accordingly, it is possible to provide the pressure contact type connector capable of having a reduced mounting area and obtaining a large elastic force. Moreover, it is possible to securely connect the pressure contact type connector and a contacted portion by the upper flat plate portion, the lower flat plate portion, the first spring, and the second spring.

In the pressure contact type connector, the upper flat plate portion may be formed by bending an upper plate portion of a metal plate having an L-shaped portion, which includes the upper plate portion extending along the vertical direction and an intermediate plate portion connected to the lower side of the upper plate portion and extending in one direction in the horizontal direction, so as to extend along the other direction which is a direction in the horizontal direction and is orthogonal to the one direction, and the first spring portion or the second spring portion may be formed by bending the intermediate plate portion so as to be wound around a virtual center line which is set along the vertical direction.

Accordingly, the metal plate having the L-shaped portion extending along the one direction in the horizontal direction is formed so as to be bent and to extend along the other direction in the horizontal direction, and thus, it is possible to easily configure the upper flat plate portion by bending it once.

In the pressure contact type connector, the lower flat plate portion may be formed by bending a lower plate portion of a metal plate having an L-shaped portion, which includes the lower plate portion extending along the vertical direction and an intermediate plate portion connected to the upper side of the lower plate portion and extending in one direction in the horizontal direction, so as to extend along the other direction which is a direction in the horizontal direction and is orthogonal to the one direction, and the first spring portion or the second spring portion may be formed by bending the intermediate plate portion so as to be wound around a virtual center line which is set along the vertical direction.

Accordingly, the metal plate having the L-shaped portion extending along the one direction in the horizontal direction is formed so as to be bent to extend along the other direction in the horizontal direction, and thus, it is possible to easily configure the lower flat plate portion by bending it once.

Moreover, in the pressure contact type connector, the first spring portion may protrude upward from the one end portion of the lower flat plate portion and may be bent so as to be wound at the upper side of the lower flat plate portion, and the second spring portion may protrude from one of the other end portion of the upper flat plate portion and the other end portion of the lower flat plate portion toward the other, and may be bent so as to be wound at the upper side of the lower flat plate portion.

Accordingly, when viewed from above in a plan view, since the lower flat plate portion does not protrude from the first spring portion and the second spring portion in at least the one end portion of the lower flat plate portion and the other end portion of the lower flat plate portion, it is possible to decrease the mounting area.

In addition, in the pressure contact type connector, a stopper portion, which is formed to protrude upward at a location of noninterference with the first spring portion and the second spring portion, may be connected to the lower flat plate portion, and a height dimension of the stopper portion may be equal to or more than a height dimension of a base portion of each of the first spring portion and the second spring portion connected to the lower flat plate portion, and may be equal to or more than a width dimension in the vertical direction of each of the first spring portion and the second spring portion.

Accordingly, it is possible to limit a displacement amount in the vertical direction, and it possible to prevent the first spring portion and the second spring portion from being damaged.

Moreover, in the pressure contact type connector, the stopper portion may be provided outside the first spring portion and the second spring portion.

Accordingly, since the stopper portion is provided outside the first spring portion and the second spring portion, it is possible to prevent a finger or the like from coming into contact with the spring portions from the side, and thus, it is possible to prevent the first spring portion and the second spring portion from being damaged. In addition, when the first spring portion and the second spring portion extend and contract in the vertical direction, the stopper can function as a guide.

Moreover, in the pressure contact type connector, the width dimensions in the vertical direction of the first spring portion and the second spring portion may decrease from the lower side toward the upper side in the entirety thereof.

Accordingly, since the width dimensions in the vertical direction of the first spring portion and the second spring portion decrease from the lower side toward the upper side, it is possible to obtain the elastic force required for a stable electrical connection, and it is possible to lengthen the strokes of the first spring portion and the second spring portion. Moreover, preferably, the width dimensions may decrease from the lower side toward the upper side in the entirety thereof, and the widths may partially increase.

In the pressure contact type connector, the second spring portion may be connected to the other end portion of the lower flat plate portion, and an auxiliary upper flat plate portion extending from the second spring portion may be provided on the lower side of the upper flat plate portion.

Accordingly, the upper flat plate portion is configured to be disposed to overlap the auxiliary upper flat plate portion, and thus, a pressing force applied to the upper flat plate portion is equally applied to the first spring portion and the second spring portion. Therefore, when the first spring portion and the second spring portion are pressed, the first spring portion and the second spring portion are not easily inclined, a predetermined elastic force can be obtained, and disadvantages such as deformation due to the inclination do not easily occur.

In addition, in the pressure contact type connector, the upper flat plate portion and the auxiliary upper flat plate portion may be disposed so as to be separated from each other in the vertical direction in a contactable manner.

Accordingly, since the upper flat plate portion and the auxiliary upper flat plate portion are disposed so as to be separated from each other, when a surface treatment such as plating is performed after the shape of the pressure contact type connector is formed, the surface treatment is also performed on the lower surface of the upper flat plate portion and the upper surface of the auxiliary upper flat plate portion, and thus, it is possible to prevent corrosion.

Moreover, according to an aspect, a manufacturing method of a pressure contact type connector includes: a punching step of forming a punched body, which includes a lower flat plate portion, a first spring portion extending from one end portion of the lower flat plate portion, an upper flat plate portion extending from the first spring portion, and a second spring portion extending from the other end portion of the lower flat plate portion opposing the one end portion of the lower flat plate portion while interposing the lower flat plate portion, in an integral flat plate shape from one metal plate; a first winding step of bendingly forming the first spring portion so as to be wound after the punching step; a second winding step of bendingly forming the second spring portion so as to be wound after the punching step; a second bending step of bending the second spring portion so as to stand upright with respect to the lower flat plate portion after the second winding step; and a first bending step of bending the first spring portion so as to stand upright with respect to the lower flat plate portion so that the first spring portion does not interfere with the second spring portion after the first winding step and the second bending step.

Accordingly, since it is possible to form the pressure contact type connector from one metal plate, it is possible to decrease the number of parts.

According to an aspect, a pressure contact type connector includes: an upper flat plate portion which extends in a flat plate shape along a horizontal direction; a lower flat plate portion which extends in a flat plate shape along a horizontal direction and is disposed below the upper flat plate portion; and a spring portion which connects one end portion of the upper flat plate portion and one end portion of the lower flat plate portion and has elasticity in a vertical direction, in which the spring portion is formed so as to be bent with respect to the upper flat plate portion and the lower flat plate portion so that a width dimension in the vertical direction is larger than a thickness dimension in the horizontal direction.

Accordingly, the spring portion is formed so that a thickness direction of the spring portion is the horizontal direction, and thus, a reduction in a size of the pressure contact type connector in the horizontal direction is achieved. In addition, when viewed from the side, since it is possible to increase the width dimension of the spring portion with respect to the directions in which the first spring portion and the second spring portion are wound, it is possible to obtain a large elastic force. Accordingly, it is possible to provide the pressure contact type connector capable of having a reduced mounting area and obtaining a large elastic force.

In the pressure contact type connector, the upper flat plate portion may be formed by bending an upper plate portion of a metal plate having an L-shaped portion, which includes the upper plate portion extending along the vertical direction and an intermediate plate portion connected to the lower side of the upper plate portion and extending in one direction in the horizontal direction, to extend along the other direction which is a horizontal direction and is orthogonal to the one direction, and the spring portion may be formed by bending the intermediate plate portion so as to be wound around a virtual center line which is set along the vertical direction.

Accordingly, the metal plate having the L-shaped portion extending along the one direction in the horizontal direction is formed so as to be bent to extend along the other direction in the horizontal direction, and thus, it is possible to easily configure the upper flat plate portion by bending it once.

In the pressure contact type connector, the lower flat plate portion may be formed by bending a lower plate portion of a metal plate having an L-shaped portion, which includes the lower plate portion extending along the vertical direction and an intermediate plate portion connected to the upper side of the lower plate portion and extending in one direction in the horizontal direction, so as to extend along the other direction which is the horizontal direction and is orthogonal to the one direction, and the spring portion may be formed by bending the intermediate plate portion so as to be wound around a virtual center line which is set along the vertical direction.

Accordingly, the metal plate having the L-shaped portion extending along the one direction in the horizontal direction is formed so as to be bent to extend along the other direction in the horizontal direction, and thus, it is possible to easily configure the lower flat plate portion by bending it once.

Moreover, in the pressure contact type connector, a stopper portion, which is formed to protrude upward at a location of noninterference with the spring portion, may be connected to the lower flat plate portion.

Accordingly, since the stopper portion is connected to the lower flat plate portion, it is possible to limit a displacement amount in the vertical direction, and it possible to prevent the first spring portion and the second spring portion from being damaged.

In the pressure contact type connector, a height dimension of the stopper portion may be equal to or more than a height dimension of a base portion of the spring portion connected to the lower flat plate portion, and may be equal to or more than a width dimension in the vertical direction of the spring portion.

Accordingly, since the height dimension of the stopper portion is equal to or more than the height dimension of the base portion and is equal to or more than the width dimension in the vertical direction of the spring portion, it is possible to limit the displacement amount in the vertical direction within a range in which the spring portion is elastically deformed, and it is possible to securely prevent the spring portion from being damaged.

In the pressure contact type connector, the stopper portion may be provided outside the spring portion.

Accordingly, since the stopper portion is provided outside the spring portion, it is possible to prevent a finger or the like from coming into contact with the spring portions from the side and to prevent the spring portion being damaged. In addition, when the spring portion extends and contracts in the vertical direction, the stopper portion can function as a guide.

Moreover, in the pressure contact type connector, the width dimension in the vertical direction of the spring portion may decrease from the lower side toward the upper side in the entirety thereof.

Accordingly, since the width dimension in the vertical direction of the spring portion decreases from the lower side toward the upper side, it is possible to obtain an elastic force required for a stable electrical connection, and it is possible to lengthen a stroke of the spring portion. Moreover, the width dimension may decrease from the lower side toward the upper side in the entirety thereof, and the width may partially increase.

Moreover, according an aspect, a manufacturing method of a pressure contact type connector includes: a punching step of forming a crank-shaped punched portion, which includes an intermediate plate portion extending in a horizontal direction, an upper plate portion connected upward to one end portion of the intermediate plate portion, and a lower plate portion connected downward to the other end portion of the intermediate plate portion, in an integral flat plate shape from one metal plate; an upper flat plate portion forming step of forming an upper flat plate portion by bending the upper plate portion after the punching step; a lower flat plate portion forming step of forming a lower flat plate portion by bending the lower plate portion after the punching step; and a spring portion forming step of forming a spring portion by bending the intermediate plate portion so as to be wound after the punching step.

Accordingly, since it is possible to form the pressure contact type connector from one metal plate, it is possible to decrease the number of parts.

According to an aspect, ded a pressure contact type connector includes: an upper flat plate portion which extends in a flat plate shape along a horizontal direction; a lower flat plate portion which extends in a flat plate shape along a horizontal direction and is disposed below the upper flat plate portion; a first spring portion which connects the upper flat plate portion and the lower flat plate portion and has elasticity in a vertical direction; and a second spring portion which is connected to at least one of the upper flat plate portion and the lower flat plate portion, extends toward the other ends of the upper flat plate portion and the lower flat plate portion, includes elasticity in the vertical direction, and is configured to apply a resilient force to the upper flat plate portion, in which the first spring portion and the second spring portion extend so as to be wound in the same direction about the upper flat plate portion when viewed from above in a plan view, the first spring portion is formed so as to be bent with respect to the upper flat plate portion and the lower flat plate portion so that a width dimension in the vertical direction is larger than a thickness dimension in the horizontal direction, and the second spring portion is formed so as to be bent with respect to at least one of the upper flat plate portion and the lower flat plate portion so that a width dimension in the vertical direction is larger than a thickness dimension in the horizontal direction.

Accordingly, the first spring portion and the second spring portion are formed so that the thickness direction of the first spring portion and the thickness direction of the second spring portion are the horizontal directions, and thus, a reduction in the size of the pressure contact type connector in the horizontal direction is achieved. In addition, when viewed from the side, since it is possible to increase width dimensions of the first spring portion and the second spring portion with respect to the directions in which the first spring portion and the second spring portion are wound, it is possible to obtain a large elastic force. Accordingly, it is possible to provide the pressure contact type connector capable of having a reduced mounting area and obtaining a large elastic force. Moreover, it is possible to securely connect the pressure contact type connector and a contacted portion by the upper flat plate portion, the lower flat plate portion, the first spring, and the second spring.

Moreover, in the pressure contact type connector, the first spring portion and the second spring portion may be provided so that the spring portions are wound in the same direction in a state where the plate surfaces of the spring portions at least partially oppose each other.

Accordingly, it is possible to decrease the sizes of the first spring and second springs while lengthening spring spans of the first spring and the second spring.

According to various embodiments, it is possible to provide the pressure contact type connector capable of having a reduced mounting area and obtaining a large elastic force.

BRIEF DESCRIPTION OF THE DRAWINGS

FIG. 2A is a plan view showing the pressure contact type connector when viewed from a Z1 direction side shown in FIG. 1, and FIG. 2B is a side view showing the pressure contact type connector when viewed from a Y2 direction side shown in FIG. 1.

FIG. 3A is a sectional view showing a section taken along line A-A shown in FIG. 2A, and FIG. 3B is a sectional view showing a section taken along line B-B shown in FIG. 2A.

FIG. 4A is a schematic sectional view showing an initial state of the pressure contact type connector, and FIG. 4B is a schematic sectional view showing an operation state of the pressure contact type connector.

FIG. 6A is a perspective view showing an outline of the pressure contact type connector, and FIG. 6B is a perspective view showing the pressure contact type connector when viewed from an X1 direction side shown in FIG. 6A.

FIG. 7A is a plan view showing the pressure contact type connector when viewed from a Z1 direction side shown in FIGS. 6A and 6B, and FIG. 7B is a side view showing the pressure contact type connector when viewed from a Y2 direction side shown in FIGS. 6A and 6B.

FIG. 9A is a schematic sectional view showing an initial state of the pressure contact type connector, and FIG. 9B is a schematic sectional view showing an operation state of the pressure contact type connector.

FIG. 11A is a plan view showing an outline of the pressure contact type connector, and FIG. 11B is a sectional view showing a section taken along line D-D shown in FIG. 11A.

FIG. 12A is a perspective view showing an outline of the pressure contact type connector, and FIG. 12B is an exploded perspective view showing a configuration of the pressure contact type connector.

FIG. 13A is a plan view showing an outline of the connection terminal, and FIG. 13B is a sectional view showing a section taken along line Z-Z shown in FIG. 13A.

DETAILED DESCRIPTION OF THE DISCLOSURE

The following description is intended to convey a thorough understanding of the embodiments described by providing a number of specific embodiments and details involving a pressure contact type connector and manufacturing method of the same. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

Figure 1:
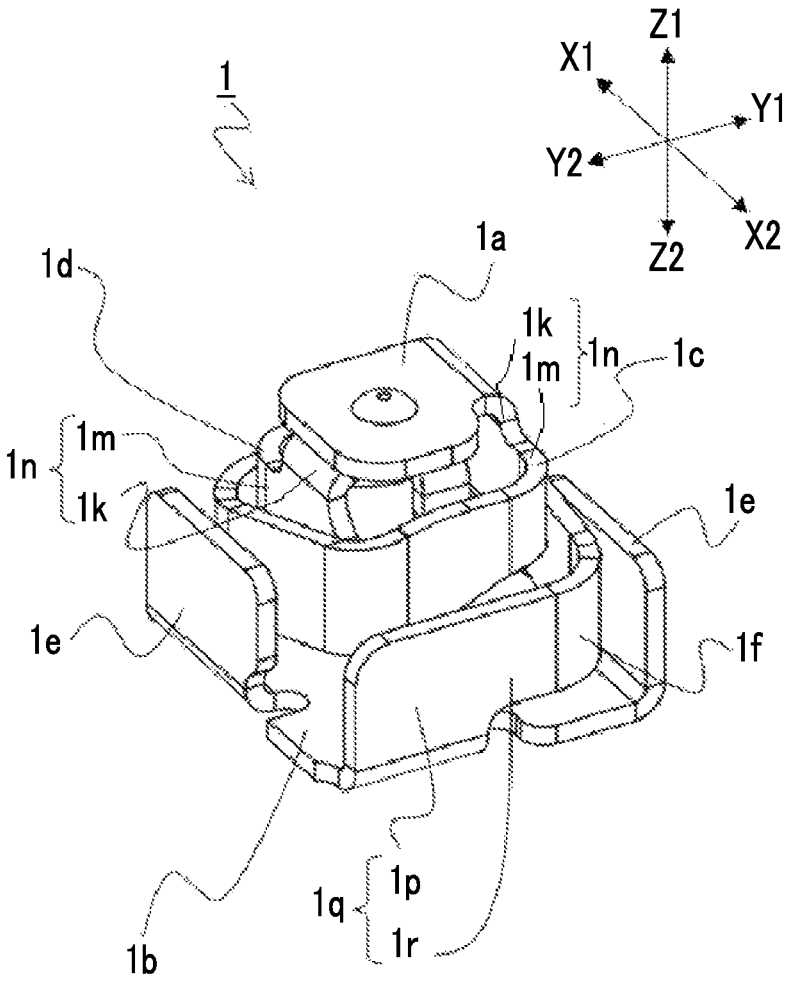
FIG. 1 is a perspective view showing an outline of a pressure contact type connector according to an example embodiment.
Figure 2A:
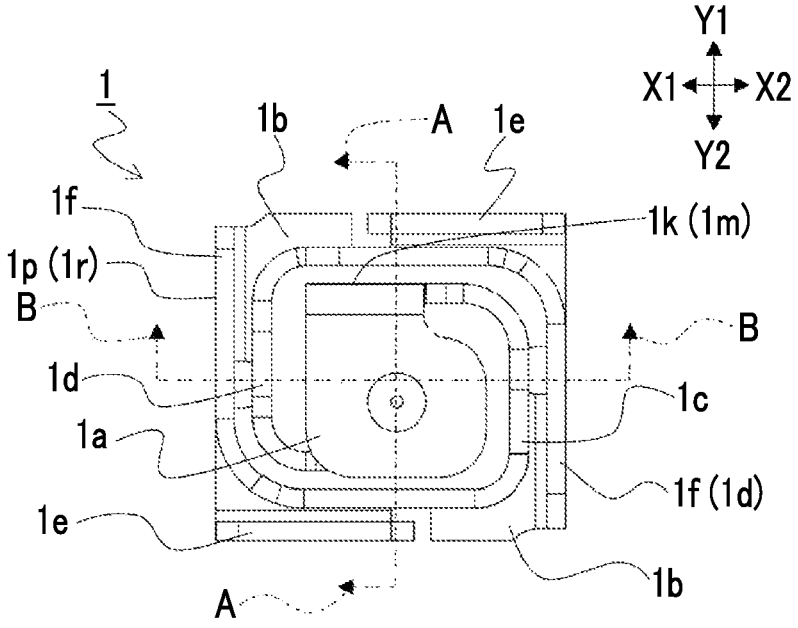
FIGS. 2A and 2B are views showing the pressure contact type connector according to an example embodiment.
Figure 2B:
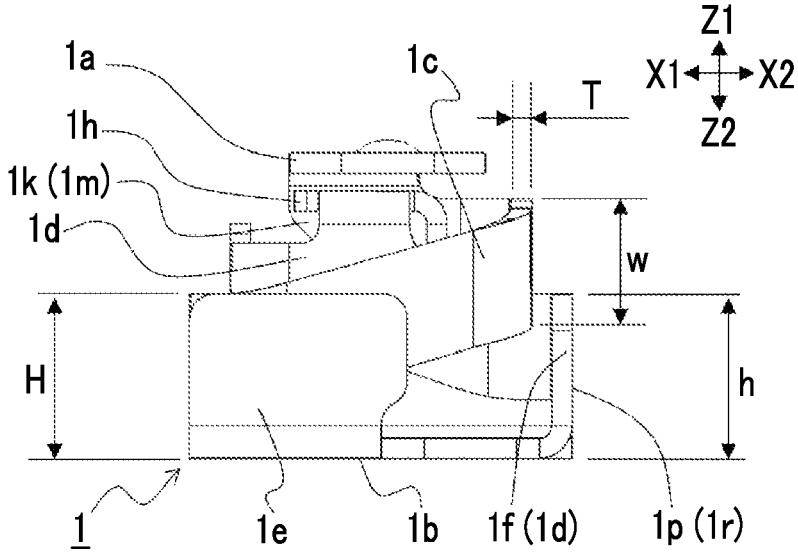
Figure 3A:
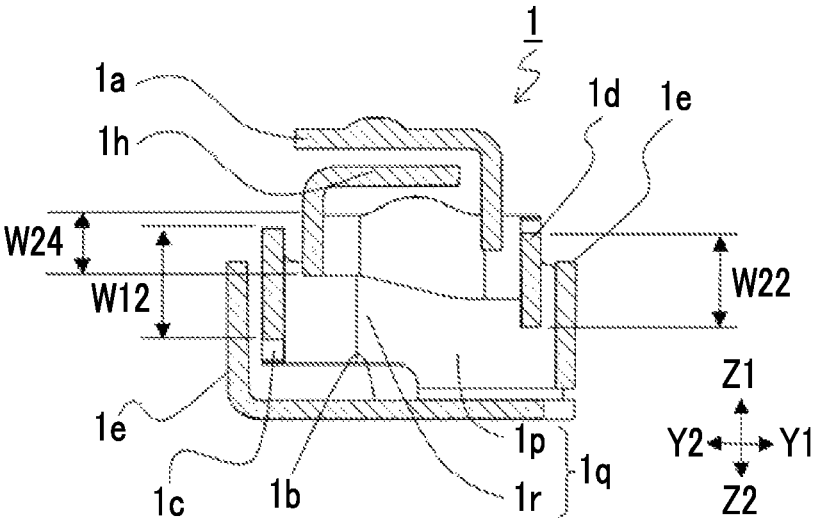
FIGS. 3A and 3B are views showing the pressure contact type connector according to an example embodiment.
Figure 3B:
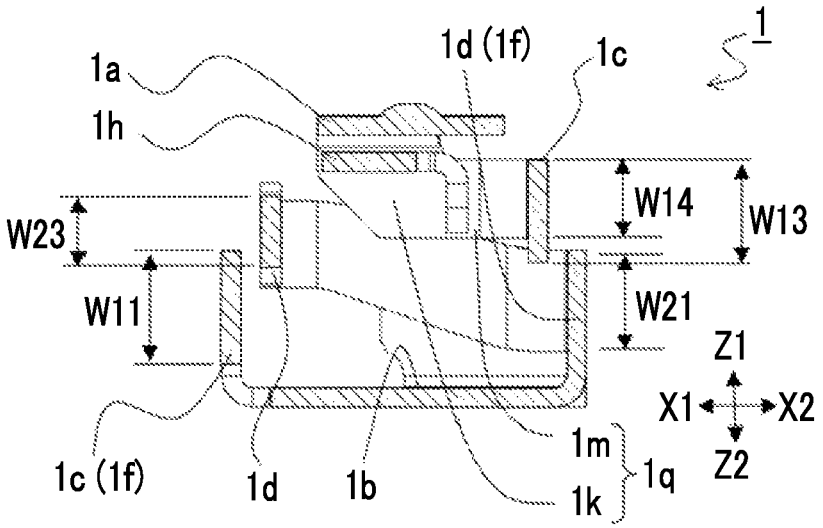

First, a configuration of a pressure contact type connector 1 according to an example embodiment will be described with reference to FIGS. 1 to 3B. FIG. 1 is a perspective view showing an outline of the pressure contact type connector 1 according to the example embodiment. FIGS. 2A and 2B are views showing the pressure contact type connector 1 according to the first embodiment, FIG. 2A is a plan view showing the pressure contact type connector 1 when viewed from a Z1 direction side shown in FIG. 1, and FIG. 2B is a side view showing the pressure contact type connector 1 when viewed from a Y2 direction side shown in FIG. 1. FIGS. 3A and 3B are views showing the pressure contact type connector 1 according to the example embodiment, FIG. 3A is a sectional view showing a section taken along line A-A shown in FIG. 2A, and FIG. 3B is a sectional view showing a section taken along line B-B shown in FIG. 2A.

As shown in FIG. 1, the pressure contact type connector 1 may be formed of a metal plate, which may include an L-shaped portion 1*n* which may include an upper plate portion 1*k* extending along a vertical direction (Z1-Z1 direction) and having a bent tip and an intermediate plate portion 1*m* connected to the lower side of the upper plate portion 1*k* and extending along a first direction (X1-X2 direction and one direction with respect to the upper plate portion 1*k*), and an L-shaped portion 1*q* which may include a lower plate portion 1*p* extending along the vertical direction and having a bent tip and an intermediate plate portion 1*r* connected to the upper side of the lower plate portion 1*p* and extending along a second direction (Y1-Y2 direction and one direction with respect to the lower plate portion 1*p*) in a horizontal direction. In addition, the pressure contact type connector 1 may include an upper flat plate portion 1*a* which may be formed by bending the upper plate portion 1*k* so as to extend along the other direction (second direction) which is the horizontal direction and is orthogonal to the first direction (one direction with respect to the upper plate portion 1*k*), and a lower flat plate portion 1*b* which is formed by bending the lower plate portion 1*p* so as to extend along the other direction (first direction) which is the horizontal direction and is orthogonal to the second direction (one direction with respect to the lower plate portion 1*p*). That is, the pressure contact type connector 1 may include the upper flat plate portion 1*a* which may extend in a flat plate shape along the horizontal direction including the X1-X2 direction and the Y1-Y2 direction, and the lower flat plate portion 1*b* which may extend in a flat plate shape along the horizontal direction and may be disposed below the upper flat plate portion 1*a*. In addition, as shown in FIGS. 2A and 2B, the upper flat plate portion 1*a* and the lower flat plate portion 1*b* may be disposed so that the upper flat plate portion 1*a* overlaps with the lower flat plate portion 1*b* in the vicinity of the center portion of the lower flat plate portion 1*b* when the pressure contact type connector 1 is viewed from above (Z1 direction side) in a plan view.

In addition, a first spring portion 1*c* or a second spring portion 1*d* may be formed by bending the intermediate plate portions 1*m* and 1*r* of a metal plate having the L-shaped portions 1*n* and 1*q* so as to be wound around a virtual center line which is set along the vertical direction, and the intermediate plate portion 1*m* extending from the upper plate portion 1*k* and the intermediate plate portion 1*r* from the lower plate portion 1*p* are integrally formed so as to be connected to each other. In addition, in such an embodiment, in the first spring portion 1*c* and the second spring portion 1*d*, the intermediate plate portion 1*m* extending from the upper plate portion 1*k* and the intermediate plate portion 1*r* extending from the lower plate portion 1*p* may be formed so as to be bent and wound around the virtual center line set along the vertical direction, and are connected to each other so as to be integrally formed. That is, the pressure contact type connector 1 may include the first spring portion 1*c* which may connect one end portion (Y1 direction side end portion) of the upper flat plate portion 1*a* and one end portion (X1 direction side end portion) of the lower flat plate portion 1*b* and may have elasticity in the vertical direction, and the second spring portion 1*d* which may extend from the other end portion (X2 direction side end) of the lower flat plate portion 1*b* toward the upper flat plate portion 1*a*, may have elasticity in the vertical direction, and may apply a resilient force to the upper flat plate portion 1*a*. In addition, in such an embodiment, the second spring portion 1*d* may extend upward from the other end portion of the lower flat plate portion 1*b* and may not be connected to the upper flat plate portion 1*a*. However, the second spring portion 1*d* may be formed so that the second spring portion 1*d* extends downward toward the lower flat plate portion 1*b* from the other end portion (Y2 direction side end portion) of the upper flat plate portion 1*a* and may not be connected to the lower flat plate portion 1*b*, or may be formed so that the second spring portion 1*d* is connected to the lower flat plate portion 1*b*. In an example embodiment, when the pressure contact type connector 1 is viewed from above in a plan view, the first spring portion 1*c* and the second spring portion 1*d* may be wound in the same direction about the upper flat plate portion 1*a*, and extends so that the spring portions 1*c* and 1*d* do not interfere with each other when being compressed and extended in the vertical direction. In addition, the first spring portion 1*c* and the second spring portion 1*d* may come into slide-contact with each other when being compressed and extended in the vertical direction, and may be positioned so that the operations in the vertical direction are not hindered.

In addition, an auxiliary upper flat plate portion 1*h* may be disposed below the upper flat plate portion 1*a*, the upper flat plate portion 1*a* may extend from the first spring portion 1*c*, the auxiliary upper flat plate portion 1*h* may extend from the second spring portion 1*d*, and the upper flat plate portion 1*a* may be disposed above the auxiliary upper flat plate portion 1*h*. The upper flat plate portion 1*a* and the auxiliary upper flat plate portion 1*h* may be disposed so as to be separated from each other in the vertical direction in a contactable manner. In such an embodiment, the end portion of the upper side (Z1 direction side) of the second spring portion 1*d* may be connected to the other end portion (Y2 direction side end portion) of the auxiliary upper flat plate portion 1*h*. The first spring portion 1*c* may be formed so as to be bent with respect to the upper flat plate portion 1*a* and the lower flat plate portion 1*b*, and the first spring portion 1*c* may protrude upward from the one end portion (a position near the Y1 direction on the X1 direction side) of the lower flat plate portion 1*b* and may be bent so as to be wound at the upper side of the lower flat plate portion 1*b*. In addition, the second spring portion 1*d* may be formed so as to be bent with respect to at least one of the upper flat plate portion 1*a* and the lower flat plate portion 1*b*, and, the second spring portion 1*d* may be formed so as to be bent with respect to the upper flat plate portion 1*a* and the lower flat plate portion 1*b*, protrudes from one (a position near the Y2 direction on the X2 direction side) of the other end portion of the auxiliary upper flat plate portion 1*h* and the other end portion of the lower flat plate portion 1*b* toward the other, and is bent so as to be wound at the upper side of the lower flat plate portion 1*b*.

Moreover, the first spring portion 1*c* and the second spring portion 1*d* may be formed so that a width dimension W of a material in the vertical direction is larger than a thickness dimension T in the horizontal direction, and the width dimension W in the vertical direction of each of the first spring portion 1*c* and the second spring portion 1*d* decreases from the lower side toward the upper side in the entirety thereof. For example, as shown by W11, W12, W13, and W14 in FIGS. 3A and 3B, the width dimensions W in the vertical direction of the first spring portion 1*c* may be different from one another according to the location. When W11, W12, W13, and W14 are arranged in a location order close to the lower side (lower flat plate portion 1*b*), W11, W12, W13, and W14 are positioned in this order, and a magnitude relationship of W11>W12>W13>W14 is satisfied. Also in the second spring portion 1*d*, as shown by W21, W22, W23, and W24, the width dimensions W in the vertical direction are different from one another according to the location. When W21, W22, W23, and W24 are arranged in a location order close to the lower side (lower flat plate portion 1*b*), W21, W22, W23, and W24 are positioned in this order, and a magnitude relationship of W21>W22>W23>W24 is satisfied. In addition, as shown in FIGS. 2A and 2B, stopper portions 1*e* which may be formed to protrude upward are connected to the lower flat plate portion 1*b* at locations of noninterference with the first spring portion 1*c* and the second spring portion 1*d*. The stopper portion 1*e* may be provided outside the first spring portion 1*c* and the second spring portion 1*d*, and in FIGS. 2A and 2B, the stopper portions 1*e* may be provided at the position near the X2 direction at the Y1 direction side end portion of the lower flat plate portion 1*b*, and at the position near the X1 direction at the Y2 direction side end portion. A height dimension H of each of the stopper portions 1*e* may be the same as a height dimension h of each of the base portions 1*f* of the first spring portion 1*c* and the second spring portion 1*d* on the lower flat plate portion 1*b*.

In addition, in the pressure contact type connector 1 of an example embodiment, the height dimension H may be the same as the height dimension h. However, the height dimension H may be equal to or more than the height dimension h, or may be equal to or more than the width dimension in the vertical direction.

Figure 4A:
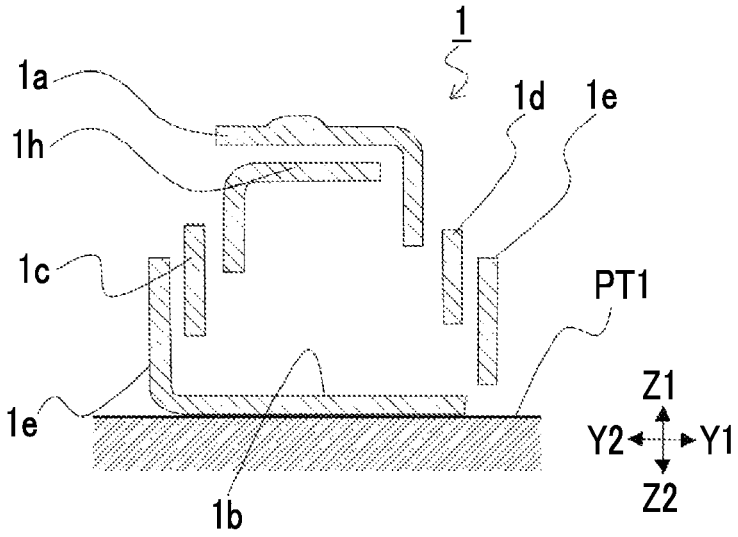
FIGS. 4A and 4B are schematic views for explaining an operation of the pressure contact type connector according to an example embodiment.
Figure 4B:
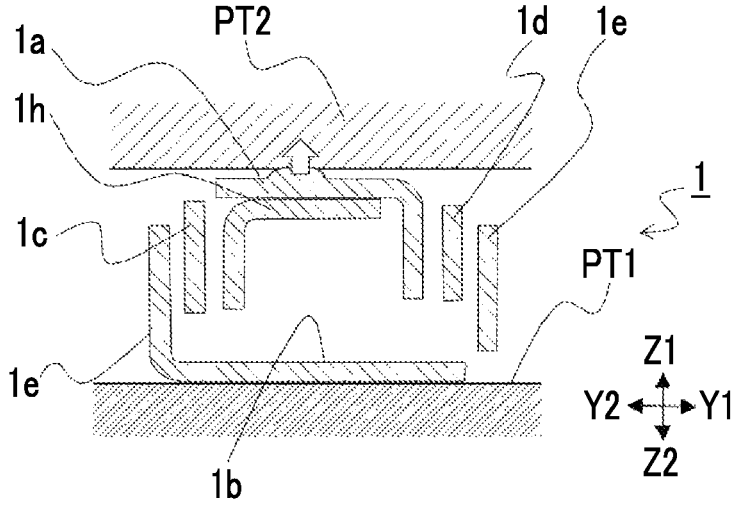

Next, an operation of the pressure contact type connector 1 will be described with reference to FIGS. 4A and 4B. FIGS. 4A and 4B are schematic views for explaining the operation of the pressure contact type connector 1 according to an example embodiment, FIG. 4A is a schematic sectional view showing an initial state of the pressure contact type connector 1, and FIG. 4B is a schematic sectional view showing the operation state of the pressure contact type connector 1.

When the pressure contact type connector 1 is actually used, as shown in FIGS. 4A and 4B, the pressure contact type connector 1 may be used for connection between a wiring pattern PT1 on a circuit substrate of a mounted electric device and a wiring pattern PT2 of a different circuit substrate, or the like. In descriptions below, a case where the pressure contact type connector 1 is disposed on the wiring pattern PT1 and the wiring pattern PT2 is disposed so as to overlap the pressure contact type connector 1 is described. However, the present invention is not limited to this.

The pressure contact type connector 1 disposed on the wiring pattern PT1 may be disposed so that the lower flat plate portion 1*b* comes into contact with the wiring pattern PT1, and the pressure contact type connector 1 and the wiring pattern PT1 are electrically connected to each other. In the initial state in which the wiring pattern PT2 may not be disposed on the pressure contact type connector 1, as shown in FIG. 4A, the upper flat plate portion 1*a* of the pressure contact type connector 1 may protrude upward by elastic forces of the first spring portion 1*c* and the second spring portion 1*d*. In addition, the upper flat plate portion 1*a* and the auxiliary upper flat plate portion 1*h* may be separated from each other.

When the wiring pattern PT2 may be disposed on the pressure contact type connector 1, as shown in FIG. 4B, the upper flat plate portion 1*a* and the auxiliary upper flat plate portion 1*h* come into contact with each other, and in a state where the second spring portion 1*d* assists the first spring portion 1*c*, the first spring portion 1*c* and the second spring portion 1*d* may be bent downward (to the Z2 direction). In this case, the pressure contact type connector 1 and the wiring pattern PT2 come into pressure-contact with each other, and thus, the pressure contact type connector 1 and the wiring pattern PT2 are electrically and stably connected to each other. That is, the wiring substrate including the wiring pattern PT1 and the wiring substrate including the wiring pattern PT2 may be electrically connected to each other via the pressure contact type connector 1.

The pressure contact type connector 1 may include: the upper flat plate portion 1*a* which extends in a flat plate shape along the horizontal direction; the lower flat plate portion 1*b* which extends in a flat plate shape along the horizontal direction and is disposed below the upper flat plate portion 1*a*; the first spring portion 1*c* which connects the one end portion of the upper flat plate portion 1*a* and the one end portion of the lower flat plate portion 1*b* and has elasticity in the vertical direction; and a second spring portion 1*d* which extends from the other end portion of the lower flat plate portion 1*b* toward the upper flat plate portion 1*a*, includes elasticity in the vertical direction, and is configured to apply a resilient force to the upper flat plate portion 1*a*, in which the first spring portion 1*c* and the second spring portion 1*d* are wound in the same direction about the upper flat plate portion 1*a* when viewed from above in a plan view, and extend so that the first spring portion and the second spring portion do not interfere with each other when the spring portions are compressed and extended in the vertical direction, the first spring portion 1*c* is formed so as to be bent with respect to the upper flat plate portion 1*a* and the lower flat plate portion 1*b* so that the width dimension W in the vertical direction is larger than the thickness dimension T in the horizontal direction, and the second spring portion 1*d* is formed so as to be bent with respect to at least one of the upper flat plate portion 1*a* and the lower flat plate portion 1*b* so that the width dimension W in the vertical direction is larger than the thickness dimension T in the horizontal direction.

Accordingly, the first spring portion 1*c* and the second spring portion 1*d* may be formed so that the thickness direction of the first spring portion 1*c* and the thickness direction of the second spring portion 1*d* are the horizontal directions, and thus, a reduction in the size of the pressure contact type connector in the horizontal direction is achieved. In addition, when viewed from the side, since it is possible to increase width dimensions of the first spring portion 1*c* and the second spring portion 1*d* with respect to the directions in which the first spring portion 1*c* and the second spring portion 1*d* are wound, it is possible to obtain a large elastic force. Accordingly, it is possible to provide the pressure contact type connector capable of having a reduced mounting area and obtaining a large elastic force. Moreover, it is possible to securely connect the pressure contact type connector and a contacted portion by the upper flat plate portion, the lower flat plate portion, the first spring, and the second spring.

In addition, in the pressure contact type connector 1 of such an embodiment, the upper flat plate portion 1*a* may be formed by bending the upper plate portion 1*k* of a metal plate having the L-shaped portion 1*n*, which includes the upper plate portion 1*k* extending along the vertical direction and the intermediate plate portion 1*m* connected to the lower side of the upper plate portion 1*k* and extending in one direction in the horizontal direction, so as to extend along the other direction which is the horizontal direction and is orthogonal to the one direction, and the first spring portion 1*c* or the second spring portion 1*d* may be formed by bending the intermediate plate portion 1*m* of metal plate having the L-shaped portion 1*n* so as to be wound around a virtual center line which is set along the vertical direction.

Accordingly, the upper plate portion 1*k* of a metal plate having the L-shaped portion 1*n* extending along the one direction in the horizontal direction may be formed so as to be bent to extend along the other direction in the horizontal direction, and thus, it is possible to easily configure the upper flat plate portion 1*a* by bending it once.

Moreover, in the pressure contact type connector 1 of an example embodiment, the lower flat plate portion 1*b* may be formed by bending the lower plate portion 1*p* of a metal plate having the L-shaped portion 1*q*, which includes the lower plate portion 1*p* extending along the vertical direction and the intermediate plate portion 1*r* connected to the upper side of the lower plate portion 1*p* and extending in one direction in the horizontal direction, so as to extend along the other direction which is the horizontal direction and is orthogonal to the one direction, and the first spring portion 1*c* or the second spring portion 1*d* may be formed by bending the intermediate plate portion 1*r* of a metal plate having the L-shaped portion 1*q* so as to be wound around a virtual center line which is set along the vertical direction.

Accordingly, the lower plate portion 1*p* of metal plate having the L-shaped portion 1*q* extending along the one direction in the horizontal direction may be formed so as to be bent to extend along the other direction in the horizontal direction, and thus, it is possible to easily configure the lower flat plate portion 1*b* by bending it once.

Moreover, in the pressure contact type connector 1 of such an embodiment, the first spring portion 1*c* may protrude upward from the one end portion of the lower flat plate portion 1*b* and may be bent so as to be wound at the upper side of the lower flat plate portion 1*b*, and the second spring portion 1*d* may protrude from the other end portion of the lower flat plate portion 1*b* toward the upper flat plate portion 1*a*, and may be bent so as to be wound at the upper side of the lower flat plate portion 1*b*.

Accordingly, when viewed from above in a plan view, since the lower flat plate portion 1*b* does not protrude from the first spring portion 1*c* and the second spring portion 1*d* in at least the one end portion (X1 direction side end portion) of the lower flat plate portion 1*b* and the other end portion (X2 direction side end portion) of the lower flat plate portion 1*b*, it is possible to decrease the mounting area. Moreover, also in the Y1 direction side end portion and the Y2 direction side end portion of the lower flat plate portion 1*b*, since the lower flat plate portion 1*b* does not protrude outside from the first spring portion 1*c* and the second spring portion 1*d*, it is possible to further decrease the mounting area.

In addition, in the pressure contact type connector 1, the stopper portion 1*e*, which may be formed to protrude upward at a location of noninterference with the first spring portion 1*c* and the second spring portion 1*d*, may be connected to the lower flat plate portion 1*b*, and the height dimension H of the stopper portion 1*e* may be the same as the height dimension h of the base portion 1*f* of each of the first spring portion 1*c* and the second spring portion 1*d* on the lower flat plate portion 1*b*.

Accordingly, when the first spring portion 1*c* and the second spring portion 1*d* are pressed downward more than necessary via the upper flat plate portion 1*a* by a part A such as an electronic device, since the stopper portion 1*e* comes into contact with the part A, it is possible to limit the displacement amount in the vertical direction of each of the first spring portion 1*c* and the second spring portion 1*d*, and thus, it is possible to prevent the first spring portion 1*c* and the second spring portion 1*d* from being damaged. Moreover, since the height dimension H of the stopper portion 1*e* is the same as the height dimension h of the base portion 1*f* of each of the first spring portion 1*c* and the second spring portion 1*d* on the lower flat plate portion 1*b*, it is possible to more securely prevent the first spring portion 1*c* and the second spring portion 1*d* from being plastically deformed.

In the pressure contact type connector 1, the stopper portion 1*e* may be provided outside the first spring portion 1*c* and the second spring portion 1*d*.

Accordingly, when the pressure contact type connector 1 is viewed from above in a plan view, since the stopper portion 1*e* is provided outside the first spring portion 1*c* and the second spring portion 1*d*, it is possible to prevent a finger or the like from coming into direct-contact with the first spring portion 1*c* and the second spring portion 1*d* from the side. Therefore, it is possible to prevent the first spring portion 1*c* and the second spring portion 1*d* from being damaged. Moreover, when the first spring portion 1*c* and the second spring portion 1*d* extend and contract in the vertical direction, the stopper can function as a guide.

In addition, in the pressure contact type connector 1, the width dimension in the vertical direction of each of the first spring portion 1*c* and the second spring portion 1*d* may decrease from the lower side toward the upper side in the entirety thereof.

Accordingly, since the width dimension W in the vertical direction of each of the first spring portion 1*c* and the second spring portion 1*d* decreases from the lower side toward the upper side, it is possible to obtain an elastic force required for a stable electrical connection, and it is possible to lengthen strokes of (to easily bent) the first spring portion 1*c* and the second spring portion 1*d*. Moreover, the width dimension may decrease from the lower side toward the upper side in the entirety thereof, and the width may partially increase.

In the pressure contact type connector 1, the second spring portion 1*d* may be connected to the other end portion of the lower flat plate portion 1*b*, and the auxiliary upper flat plate portion 1*h* extending from the second spring portion 1*d* may be provided on the lower side of the upper flat plate portion 1*a*.

Accordingly, the upper flat plate portion 1*a* may be configured to be disposed to overlap the auxiliary upper flat plate portion 1*h*, and thus, the pressure applied to the upper flat plate portion 1*a* may be equally applied to the first spring portion 1*c* and the second spring portion 1*d*. Therefore, when the first spring portion 1*c* and the second spring portion 1*d* are pressed, the first spring portion 1*c* and the second spring portion 1*d* are not easily inclined, a predetermined elastic force can be obtained, and disadvantages such as deformation due to inclination do not easily occur.

In the pressure contact type connector 1, the upper flat plate portion 1*a* and the auxiliary upper flat plate portion 1*h* may be disposed so as to be separated from each other in the vertical direction in a contactable manner.

Accordingly, since the upper flat plate portion 1*a* and the auxiliary upper flat plate portion 1*h* are disposed so as to be separated from each other, when a surface treatment such as plating is performed after the shape of the pressure contact type connector 1 is formed, the surface treatment is also performed on the lower surface of the upper flat plate portion 1*a* and the upper surface of the auxiliary upper flat plate portion 1*h*, and thus, it is possible to prevent corrosion.

In addition, in the pressure contact type connector 1, when viewed from above, since the first spring portion 1*c* and the second spring portion 1*d* are disposed to oppose each other while the upper flat plate portion 1*a* is interposed therebetween, the upper flat plate portion 1*a* is not easily inclined when being pressed and can easily move along the vertical direction.

Figure 5:
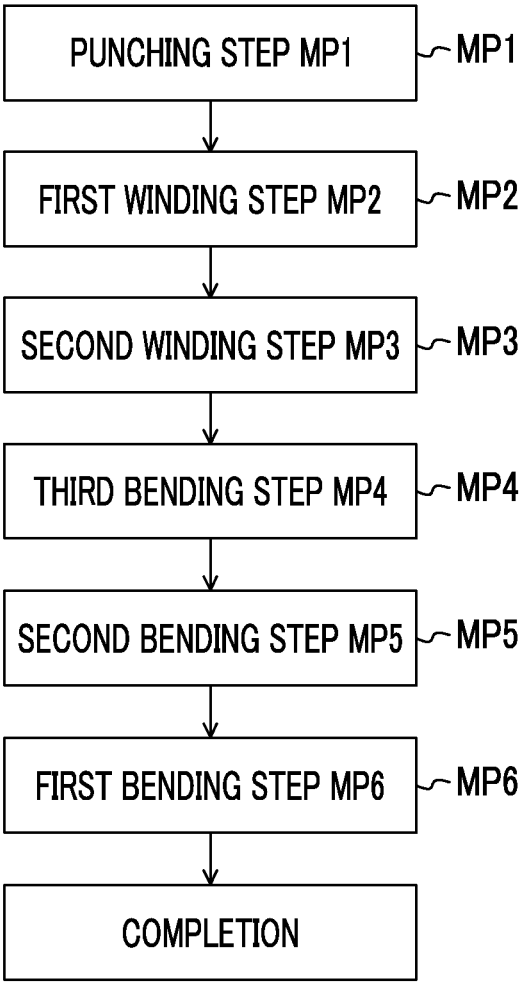
FIG. 5 is a flow chart showing a process of a manufacturing method of the pressure contact type connector according to an example embodiment.

Hereinafter, a manufacturing method MP of the pressure contact type connector 1 according to an example embodiment will be described with reference to FIG. 5. FIG. 5 is a flow chart showing a process of the manufacturing method MP of the pressure contact type connector 1 according to an example embodiment. The manufacturing method MP includes a punching step MP1, a first winding step MP2, a second winding step MP3, a third bending step MP4, a second bending step MP5, and a first bending step MP6. As shown in FIG. 5, first, the punching step MP1 is performed. In the punching step MP1, a punched body 5 (not shown), which may include the lower flat plate portion 1*b*, the first spring portion 1*c* extending from the one end portion of the lower flat plate portion 1*b* integrally with the upper flat plate portion 1*a*, and the second spring portion 1*d* extending from the other end portion of the lower flat plate portion 1*b*, may be formed in an integral flat plate shape from one metal plate. After the punching step MP1, the first winding step MP2 may be performed. In the first winding step MP2, the punched body 5 may be formed so as to be bent and wound the first spring portion 1*c*. After the first winding step MP2, the second winding step MP3 may be performed. In the second winding step MP3, the punched body 5 may be formed so as to be bent to wind the second spring portion 1*d*. In addition, the second winding step MP3 may be performed after the punching step MP1, and thereafter, the first winding step MP2 may be performed. After the second winding step MP3, the third bending step MP4 may be performed. In the third bending step MP4, the punched body 5 may be formed so as to be bent to extend the stopper portion 1*e* upward. After the third bending step MP4, the second bending step MP5 may be performed. In the second bending step MP5, the second spring portion 1*d* may be bent so as to stand upright with respect to the lower flat plate portion 1*b*. After the second bending step MP5, the first bending step MP6 may be performed. In the first bending step MP6, the first spring portion 1*c* stands upright with respect to the lower flat plate portion 1*b* so that the first spring portion 1*c* does not interfere with the second spring portion 1*d*. According to the manufacturing processes, the pressure contact type connector 1 is completed. Moreover, the manufacturing process is described in which the third bending step MP4 is performed after the first winding step MP2 and the second winding step MP3. However, for example, the second bending step MP5 and the first bending step MP6 may be performed after the first winding step MP2 and the second winding step MP3, and thereafter, the third bending step MP4 may be performed. In addition, the upper flat plate portion 1*a* is formed at the first winding step MP2, and the auxiliary upper flat plate portion 1*h* is formed at the second winding step MP3.

The manufacturing method MP of the pressure contact type connector 1, may include: the punching step MP1 of forming the punched body 5, which includes the lower flat plate portion 1*b*, the first spring portion 1*c* extending from one end portion of the lower flat plate portion 1*b* integrally with the upper flat plate portion 1*a*, and the second spring portion 1*d* extending from the other end portion of the lower flat plate portion 1*b* opposing the one end portion of the lower flat plate portion 1*b* while interposing the lower flat plate portion 1*b*, in an integral flat plate shape from one metal plate; the first winding step MP2 of bendingly forming the first spring portion 1*c* so as to be wound after the punching step MP1; the second winding step MP3 of bendingly forming the second spring portion 1*d* so as to be wound after the punching step MP1; the second bending step MP5 of bending the second spring portion 1*d* so as to stand upright with respect to the lower flat plate portion 1*b* after the second winding step MP3; and the first bending step MP6 of bending the first spring portion 1*c* so as to stand upright with respect to the lower flat plate portion 1*b* so that the first spring portion 1*c* does not interfere with the second spring portion 1*d* after the first winding step MP2 and the second bending step MP5.

Accordingly, since it is possible to form the pressure contact type connector from one metal plate, it is possible to decrease the number of parts.

In the embodiment described above, the integrated intermediate portions 1*m* and 1*r* may be bent three times by approximately 90°, and are formed within a range of approximately 270° in a plan view. However, the intermediate portions may be formed in a spiral shape in which arcs are formed, and the formation range may be 90° or more, and preferably, may be 180° or more.

Figure 6A:
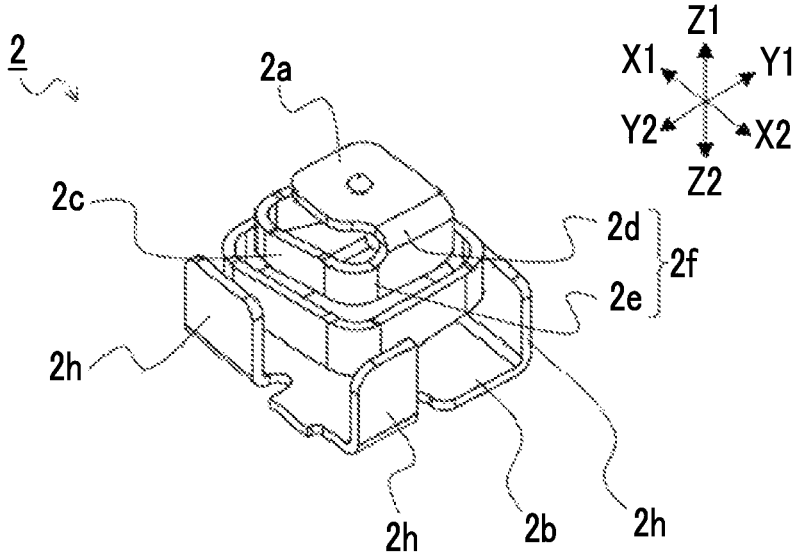
FIGS. 6A and 6B are views showing the pressure contact type connector according to an example embodiment.
Figure 6B:
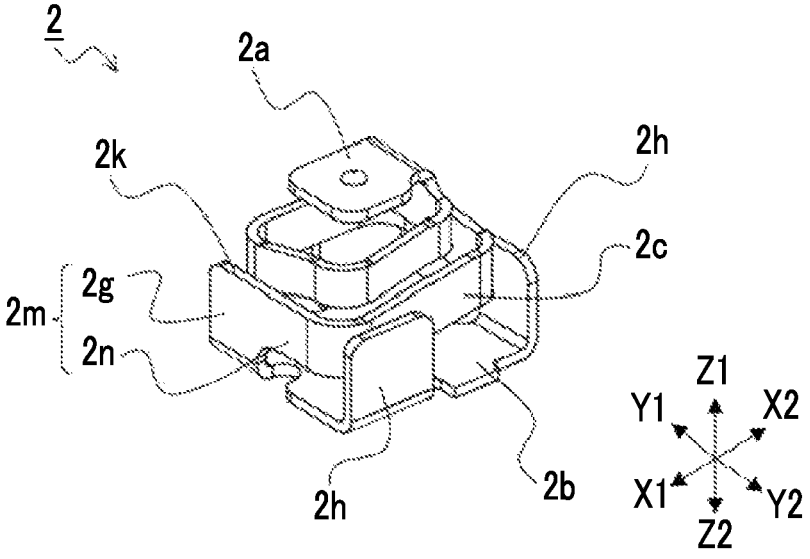
Figure 7A:
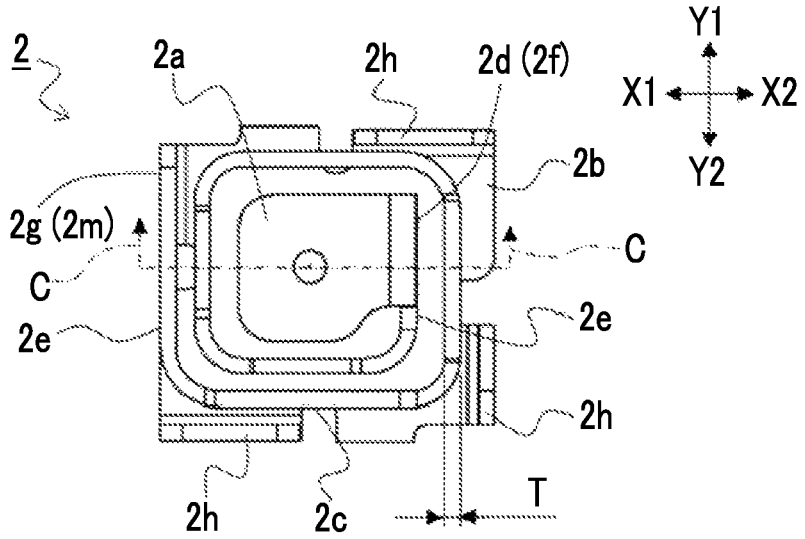
FIGS. 7A and 7B are views showing the pressure contact type connector according to an example embodiment.
Figure 7B:
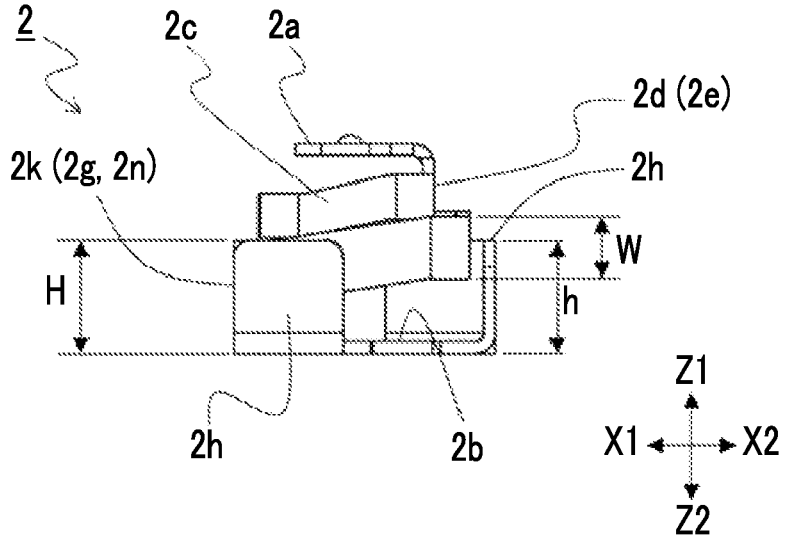
Figure 8:
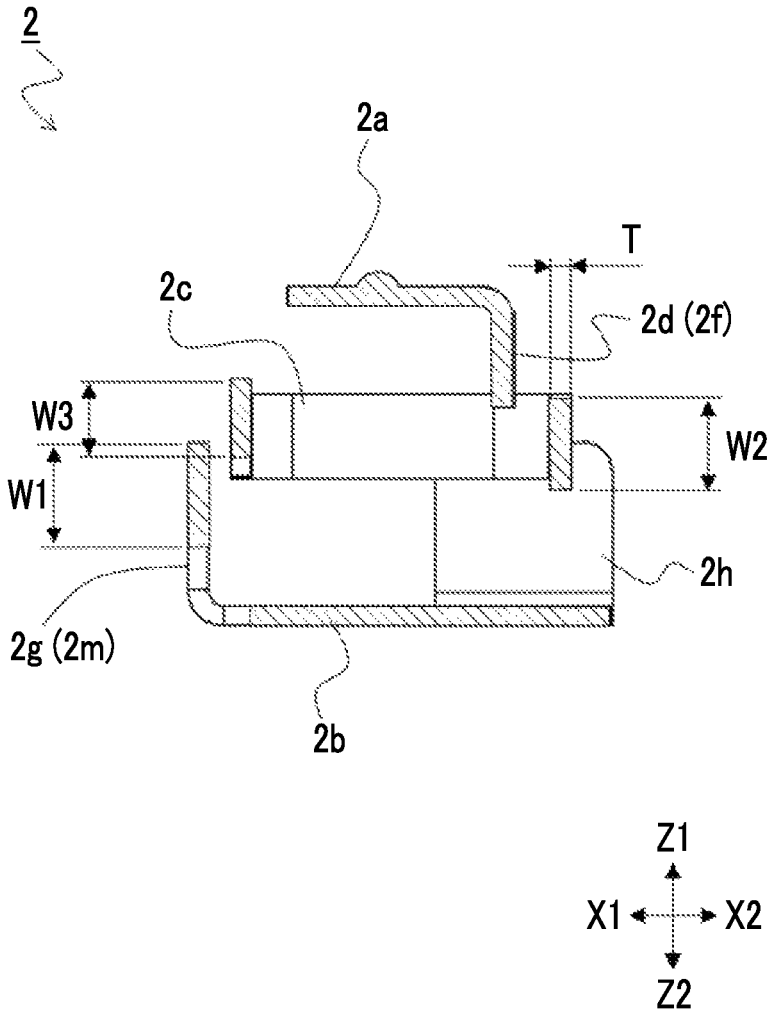
FIG. 8 is a sectional view showing a section of the pressure contact type connector according to an example embodiment taken along line C-C shown in FIGS. 7A and 7B.

A configuration of a pressure contact type connector 2 an example embodiment will be described with reference to FIGS. 6A to 8. FIGS. 6A and 6B are views showing the pressure contact type connector 2 according to the second embodiment, FIG. 6A is a perspective view showing an outline of the pressure contact type connector 2, and FIG. 6B is a perspective view showing the pressure contact type connector 2 when viewed from the X1 direction side shown in FIG. 6A. FIGS. 7A and 7B are views showing the pressure contact type connector 2 according to the second embodiment, FIG. 7A is a plan view showing the pressure contact type connector 2 when viewed from the Z1 direction side shown in FIGS. 6A and 6B, and FIG. 7B is a side view showing the pressure contact type connector 2 when viewed from the Y2 direction side shown in FIGS. 6A and 6B. FIG. 8 is a sectional view showing a section of the pressure contact type connector 2 according to the second embodiment taken along line C-C shown in FIGS. 7A and 7B.

As shown in FIGS. 6A and 6B, the pressure contact type connector 2 may include: an upper flat plate portion 2*a* which may extend along the horizontal direction including the X1-X2 direction and the Y1-Y2 direction and has a flat plate shape; a lower flat plate portion 2*b* which may extend along the horizontal direction, may have a flat plate shape and may be disposed below the upper flat plate portion 2*a*; and a spring portion 2*c* which may connect one end portion (end portion of the X2 direction side) of the upper flat plate portion 2*a* and one end portion (end portion of the X1 direction side) of the lower flat plate portion 2*b* and has elasticity in the vertical direction (Z1-Z2 direction). The pressure contact type connector 2 may be formed of a metal plate, which may include an L-shaped portion 2*f* which may include an upper plate portion 2*d* extending along the vertical direction and having a bent tip and an intermediate plate portion 2*e* connected to the lower side (Z2 direction side) of the upper plate portion 2*d* and extending along one direction (Y1-Y2 direction) in the horizontal direction, and an L-shaped portion 2*m* which includes a lower plate portion 2*g* extending along the vertical direction and an intermediate plate portion 2*n* connected to the upper side (Z1 direction side) of the lower plate portion 2*g* and extending along one direction in the horizontal direction. The upper flat plate portion 2*a* may be formed by bending the upper plate portion 2*d* so as to extend along the other direction (X1-X2 direction) which is the horizontal direction and is orthogonal to the one direction, and the lower flat plate portion 2*b* is formed by bending the lower plate portion 2*g* so as to extend along the other direction which is the horizontal direction and is orthogonal to the one direction.

As shown in FIGS. 7A and 7B, the spring portion 2*c* may be formed so as to be bent with respect to the upper flat plate portion 2*a* and the lower flat plate portion 2*b*, and may be formed by bending the intermediate plate portions 2*e* and 2*n* of a metal plate having the L-shaped portions 2*f* and 2*m* so as to be wound around the virtual center line set along the vertical direction and by connecting the intermediate plate portion 2*e* extending downward from the upper plate portion 2*d* and the intermediate plate portion 2*n* extending upward from the lower plate portion 2*g*. In addition, the width dimension W of a material in the vertical direction of the spring portion 2*c* is larger than the thickness dimension T in the horizontal direction. As shown in FIG. 8, the width dimension W in the vertical direction of the spring portion 2*c* may decrease from the lower side toward the upper side in the entirety thereof. For example, as shown by W1, W2, and W3 in FIG. 8, the width dimensions W in the vertical direction of the spring portion 2*c* are different from one another according to the location. When W1, W2, and W3 are arranged in a location order close to the lower side (lower flat plate portion 2*b*), W1, W2, and W3 are positioned in this order, and a magnitude relationship of W1>W2>W3> is satisfied.

In addition, as shown in FIGS. 7A and 7B, stopper portions 2*h* which are formed to protrude upward may be connected to the lower flat plate portion 2*b* at locations of noninterference with the spring portion 2*c*. The stopper portions 2*h* may be provided outside the spring portions 2*c* when viewed from above in a plan view. In addition, the stopper portions 2*h* may be formed so as to protrude upward from the end portions of the X2 direction side, the Y1 direction side, and the Y2 directions side of the lower flat plate portion 2*b*. A height dimension h of each of the stopper portions 2*h* may be the same as a height dimension H of a base portion 2*k* of each of the spring portions 2*c* connected to the lower flat plate portion 2*b*. In addition, the height dimension h may be the same as the height dimension H. However, the height dimension h of the stopper portion 2*h* may be equal to or more than the height dimension H of the base portion 2*k* or equal to or more than the width dimension in the vertical direction of the spring portion 2*c*.

Figure 9A:
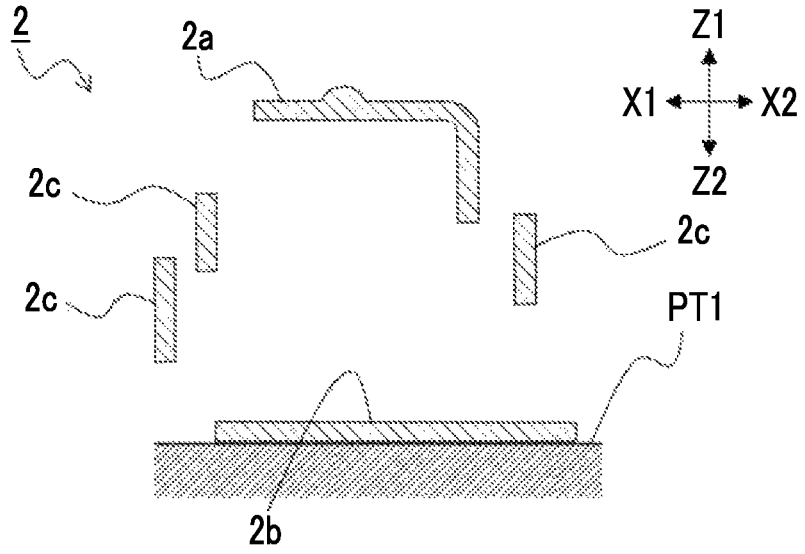
FIGS. 9A and 9B are schematic views for explaining an operation of the pressure contact type connector according to an example embodiment.
Figure 9B:
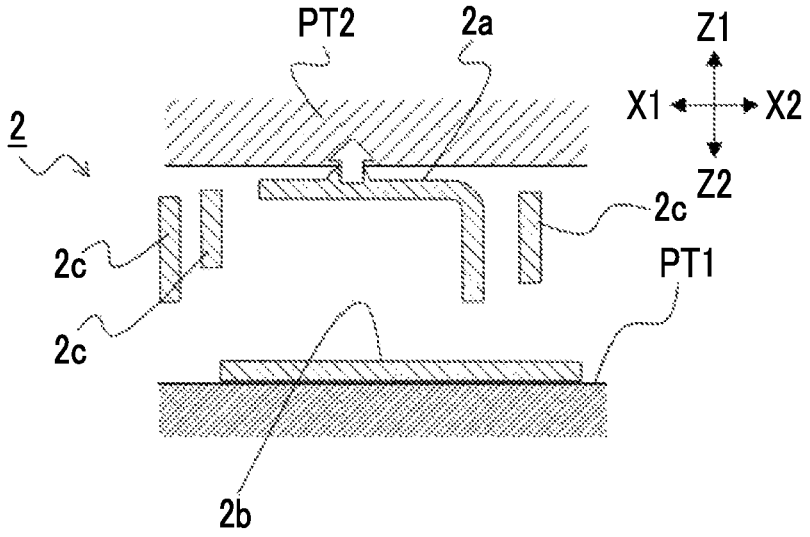

Next, the operation of the pressure contact type connector 2 will be described with reference to FIGS. 9A and 9B. FIGS. 9A and 9B are schematic views for explaining the operation of the pressure contact type connector 2 according to an example embodiment, FIG. 9A is a schematic sectional view showing an initial state of the pressure contact type connector 2, and FIG. 9B is a schematic sectional view showing the operation state of the pressure contact type connector 1.

When the pressure contact type connector 2 is actually used, as shown in FIGS. 9A and 9B, the pressure contact type connector 1 may be used for connection between the wiring pattern PT1 on a circuit substrate of the mounted electric device and the wiring pattern PT2 of a different circuit substrate, or the like. In descriptions below, a case where the pressure contact type connector 2 is disposed on the wiring pattern PT1 and the wiring pattern PT2 may be disposed so as to overlap the pressure contact type connector 2 is described. However, the present invention is not limited to this.

The pressure contact type connector 2 disposed on the wiring pattern PT1 may be disposed so that the lower flat plate portion 2*b* comes into contact with the wiring pattern PT1, and the pressure contact type connector 2 and the wiring pattern PT2 are electrically connected to each other. In the initial state in which the wiring pattern PT2 is not disposed on the pressure contact type connector 2, as shown in FIG. 9A, the upper flat plate portion 2*a* of the pressure contact type connector 1 protrudes upward by the elastic force of the spring portion 2*c*.

When the wiring pattern PT2 is disposed on the pressure contact type connector 2, as shown in FIG. 9B, the pressure contact type connector 2 may be bent downward (Z2 direction). In this case, the pressure contact type connector 2 and the wiring pattern PT2 come into pressure-contact with each other, and thus, the pressure contact type connector 2 and the wiring pattern PT2 may be electrically and stably connected to each other. That is, the wiring substrate including the wiring pattern PT1 and the wiring substrate including the wiring pattern PT2 may be electrically connected to each other via the pressure contact type connector 2.

In the pressure contact type connector 2 may include: the upper flat plate portion 2*a* which extends in a flat plate shape along the horizontal direction; the lower flat plate portion 2*b* which extends in a flat plate shape along the horizontal direction and is disposed below the upper flat plate portion 2*a*; and the spring portion 2*c* which connects one end portion of the upper flat plate portion 2*a* and one end portion of the lower flat plate portion 2*b* and has elasticity in the vertical direction, in which the spring portion 2*c* is formed so as to be bent with respect to the upper flat plate portion 2*a* and the lower flat plate portion 2*b* so that the width dimension in the vertical direction is larger than the thickness dimension in the horizontal direction.

Accordingly, the spring portion 2*c* may be formed so that the thickness direction of the spring portion 2*c* is the horizontal direction, and thus, a reduction in the size of the pressure contact type connector in the horizontal direction is achieved. In addition, when viewed from the side, since it is possible to increase the width dimension of the spring portion 2*c* with respect to the directions in which the spring portion 2*c* are wound, it is possible to obtain a large elastic force. Accordingly, it is possible to provide the pressure contact type connector capable of having a reduced mounting area and obtaining a large elastic force.

In addition, in the pressure contact type connector 2, the upper flat plate portion 2*a* may be formed by bending the upper plate portion 2*d* of a metal plate having the L-shaped portion 2*f*, which may include the upper plate portion 2*d* extending along the vertical direction and an intermediate plate portion 2*e* connected to the lower side of the upper plate portion 2*d* and extending in one direction in the horizontal direction, to extend along the other direction which is the horizontal direction and is orthogonal to the one direction, and the spring portion 2*c* may be formed by bending the intermediate plate portion 2*e* of a metal plate having the L-shaped portion 2*f* so as to be wound around a virtual center line which may be set along the vertical direction.

Accordingly, the upper plate portion 2*d* of a metal plate having the L-shaped portion 2*f* extending along the one direction in the horizontal direction may be formed so as to be bent to extend along the other direction in the horizontal direction, and thus, it is possible to easily configure the upper flat plate portion 2*a* by bending it once.

In addition, in the pressure contact type connector 2, the lower flat plate portion 2*b* may be formed by bending the lower plate portion 2*g* of a metal plate having the L-shaped portion 2*m*, which may include the lower plate portion 2*g* extending along the vertical direction and the intermediate plate portion 2*n* connected to the upper side of the lower plate portion 2*g* and extending in one direction in the horizontal direction, so as to extend along the other direction which is the horizontal direction and is orthogonal to the one direction, and the spring portion 2*c* may be formed by bending the intermediate plate portion 2*n* of a metal plate having the L-shaped portion 2*m* so as to be wound around a virtual center line which is set along the vertical direction.

Accordingly, the lower plate portion 2*g* of a metal plate having the L-shaped portion 2*m* extending along the one direction in the horizontal direction may be formed so as to be bent to extend along the other direction in the horizontal direction, and thus, it is possible to easily configure the lower flat plate portion 2*b* by bending it once.

Moreover, in the pressure contact type connector 2, the stopper portion 2*h*, which is formed to protrude upward at a location of noninterference with the spring portion 2*c*, may be connected to the lower flat plate portion 2*b*.

Accordingly, since the stopper portion 2*h* may be connected to the lower flat plate portion 2*b*, it is possible to limit a displacement amount in the vertical direction, and it possible to prevent the spring portion 2*c* from being damaged.

In addition, in the pressure contact type connector 2, the height dimension of the stopper portion 2*h* may be equal to or more than the height dimension of the base portion 2*k* of the spring portion 2*c* connected to the lower flat plate portion 2*b*.

Accordingly, since the height dimension of the stopper portion 2*h* may be equal to or more than the height dimension of the base portion 2*k*, it is possible to limit the displacement amount in the vertical direction within a range in which the spring portion 2*c* is elastically deformed, and it is possible to securely prevent the spring portion 2*c* from being damaged.

Moreover, in the pressure contact type connector 2, the stopper portion 2*h* may be provided outside the spring portion 2*c*.

Accordingly, since the stopper portion 2*h* may be provided outside the spring portion 2*c*, it is possible to prevent a finger or the like from coming into contact with the spring portions from the side and to prevent the spring portion 2*c* being damaged. In addition, when the spring portion 2*c* extends and contracts in the vertical direction, the stopper portion 2*h* can function as a guide.

In the pressure contact type connector 2, the width dimension in the vertical direction of the spring portion 2*c* may decrease from the lower side toward the upper side in the entirety thereof.

Accordingly, since the width dimension in the vertical direction of the spring portion 2*c* may decrease from the lower side toward the upper side, it is possible to obtain an elastic force required for a stable electrical connection, and it is possible to lengthen the stroke of the spring portion 2*c*. Moreover, the width dimension may decrease from the lower side toward the upper side in the entirety thereof, and the width may partially increase.

Figure 10:
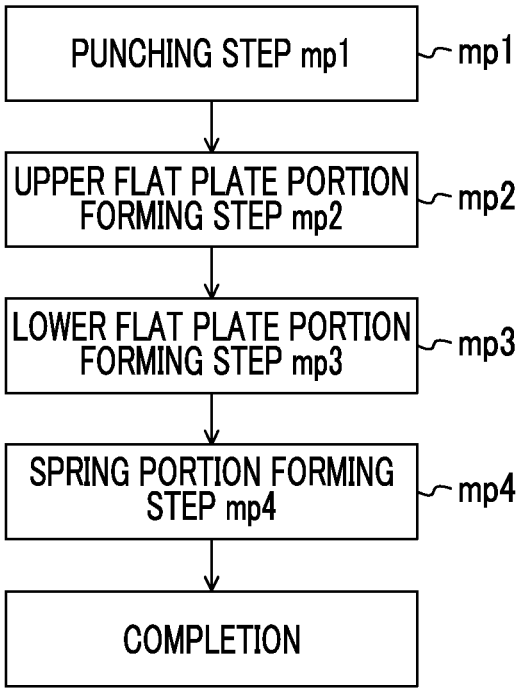
FIG. 10 is a flow chart showing a process of a manufacturing method of the pressure contact type connector according to an example embodiment.

Hereinafter, a manufacturing method mp of the pressure contact type connector 2 will be described with reference to FIG. 10. FIG. 10 is a flow chart showing a process of the manufacturing method mp of the pressure contact type connector 2 according to an example embodiment. The manufacturing method mp may include a punching step mp1, an upper flat plate portion forming step mp2, a lower flat plate portion forming step mp3, and a spring portion forming step mp4. As shown in FIG. 10, first, the punching step mp1 may be performed. In the punching step mp1, a crank-shaped punched portion 6 (not shown), which includes the intermediate plate portion 2*e* extending in the horizontal direction, the upper plate portion 2*d* connected upward to the one end portion of the intermediate plate portion 2*e*, and the lower plate portion 2*g* connected downward to the other end portion of the intermediate plate portion 2*e*, may be formed in an integral flat plate shape from one metal plate. After the punching step mp1, the upper flat plate portion forming step mp2 may be performed. In the upper flat plate portion forming step mp2, the upper plate portion 2*d* of the crank-shaped punched portion 6 may be bent to form the upper flat plate portion 2*a*. After the upper flat plate portion forming step mp2, the lower flat plate portion forming step mp3 may be performed. In the lower flat plate portion forming step mp3, the lower plate portion 2*g* of the crank-shaped punched portion 6 may be bent to form the lower flat plate portion 2*b*. In addition, the lower flat plate portion forming step mp3 may be performed after the punching step mp1, and thereafter, the upper flat plate portion forming step mp2 may be performed. After the lower flat plate portion forming step mp3, the spring portion forming step mp4 may be performed. In the spring portion forming step mp4, the intermediate plate portion 2*e* of the crank-shaped punched portion 6 may be bent so as to be wound to form the spring portion 2*c*. According to the manufacturing processes, the pressure contact type connector 2 may be completed.

The manufacturing method mp of the pressure contact type connector 2 may include: the punching step mp1 of forming the crank-shaped punched portion 6, which includes the integral intermediate plate portions 2*e* and 2*m* extending in the horizontal direction, the upper plate portion 2*d* connected upward to the one end portion of the intermediate plate portions 2*e* and 2*m*, and the lower plate portion 2*g* connected downward to the other end portion of the intermediate plate portion 2*e*, in an integral flat plate shape from one metal plate; the upper flat plate portion forming step mp2 of forming the upper flat plate portion 2*a* by bending the upper plate portion 2*d* after the punching step mp1; the lower flat plate portion forming step mp3 of forming the lower flat plate portion 2*b* by bending the lower plate portion 2*g* after the punching step mp1; and the spring portion forming step mp4 of forming the spring portion 2*c* by bending the intermediate plate portions 2*e* and 2*m* so as to be wound after the punching step mp1.

Accordingly, since it is possible to form the pressure contact type connector from one metal plate, it is possible to decrease the number of parts.

Figure 11A:
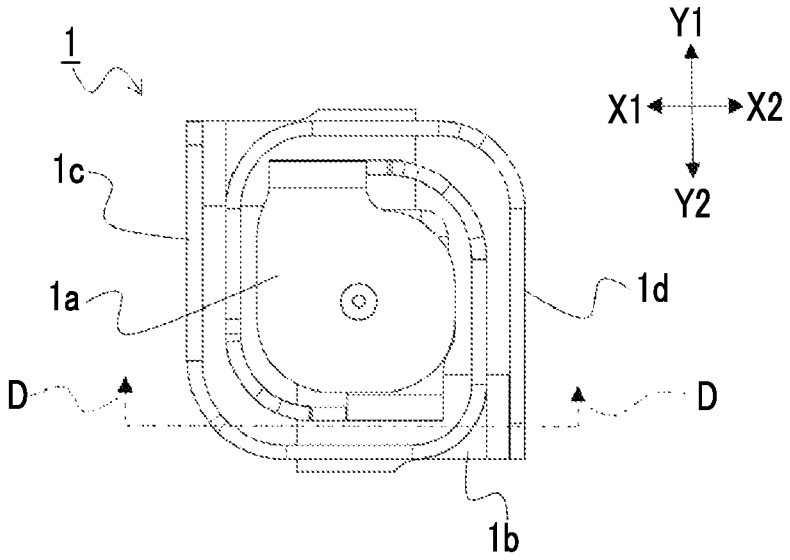
FIGS. 11A and 11B are views showing a pressure contact type connector according to an example embodiment.
Figure 11B:
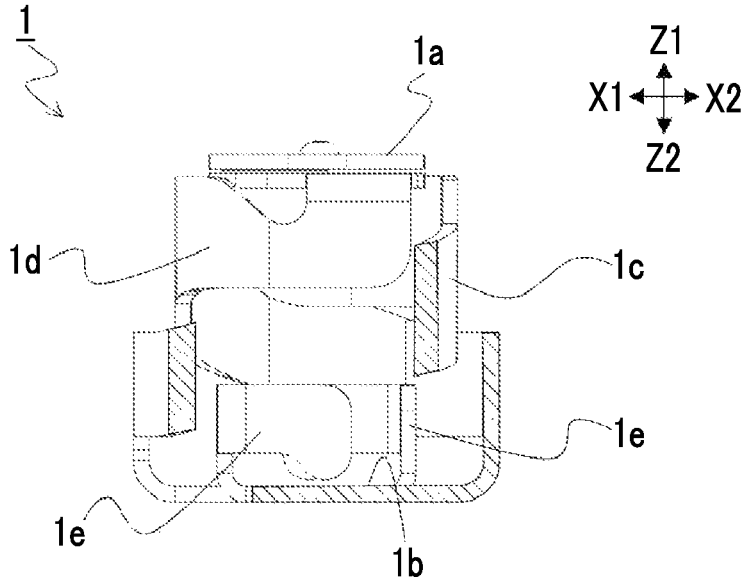
Figure 12A:
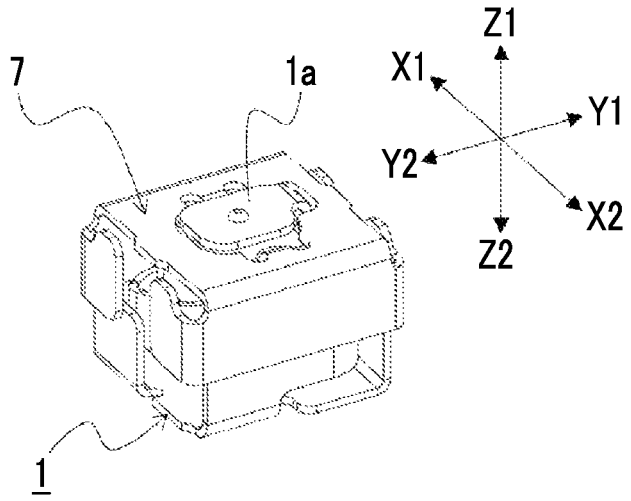
FIGS. 12A and 12B are views showing a pressure contact type connector according to an example embodiment.
Figure 12B:
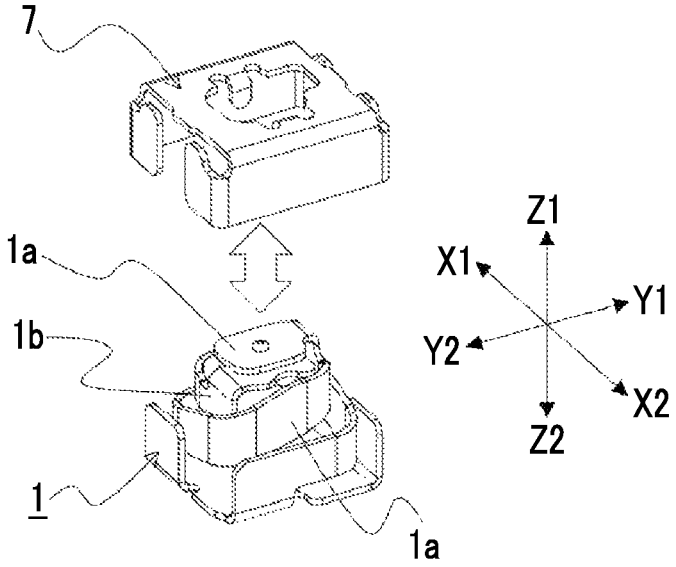
Figure 13A:
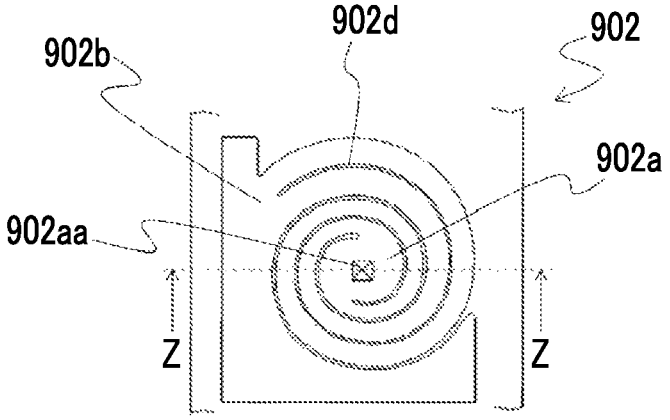
FIG. 13A PRIOR ART
FIGS. 13A and 13B are views showing a structure of a connection terminal of a pressure contact type connector disclosed in Japanese Unexamined Patent Application Publication No. 2010-118256.
Figure 13B:
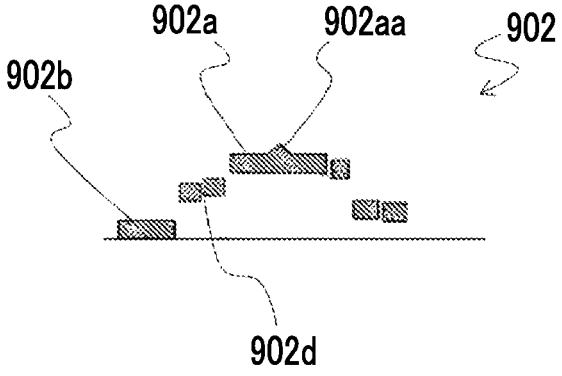
FIG. 13B PRIOR ART

Hereinbefore, the pressure contact type connectors according to embodiments of the present invention and the manufacturing methods thereof are described. However, the present invention is not limited to the above-described embodiments, and various modifications may be performed within the scope which does not depart from the gist of the invention. For example, the present invention may be modified as follows, and the modified embodiments are also included in the present invention. Moreover, in descriptions with respect to the following embodiments, pressure contact type connectors having shapes different from the shape of the pressure contact type connector 1 according to the first embodiment will be described. However, for easy explanation, names of parts, reference numerals, or the like used for explanations of the pressure contact type connector 1 according to the first embodiment are used for names of parts, reference numerals, or the like of the following embodiments. In addition, FIGS. 11A and 11B used for the explanations are views showing the pressure contact type connector 1 according to an example embodiment, FIG. 11A is a plan view showing an outline of the pressure contact type connector 1, and FIG. 11B is a sectional view showing a section taken along line D-D shown in FIG. 11A. FIGS. 12A and 12B are views showing the pressure contact type connector 1 according to a fifth embodiment, FIG. 12A is a perspective view showing an outline of the pressure contact type connector 1, and FIG. 12B is an exploded perspective view showing a configuration of the pressure contact type connector 1.

In an above-described embodiment, the upper flat plate portion 1*a* may include the upper flat plate portion 1*a* and the auxiliary upper flat plate portion 1*h*. The upper flat plate portion 1*a* may be configured to include only the upper flat plate portion 1*a* according to the first embodiment, and the lower surface of the upper flat plate portion 1*a* may be held by the tip portion of the upper side of the second spring portion 1*d*.

In the above-described embodiments, the stopper portion 1*e* may be provided outside the first spring portion 1*c* and the second spring portion 1*d*. However, as shown in FIGS. 11A and 11B, the stopper portion 1*e* may be provided inside the first spring portion 1*c* and the second spring portion 1*d* and below the upper flat plate portion 1*a*. Accordingly, when the first spring portion 1*c* and the second spring portion 1*d* may be pressed downward more than necessary via the upper flat plate portion 1*a* by the part A, since the stopper portion 1*e* comes into contact with the part A via the upper flat plate portion 1*a*, it is possible to limit the displacement amount in the vertical direction of each of the first spring portion 1*c* and the second spring portion 1*d*, and thus, it is possible to prevent the first spring portion 1*c* and the second spring portion 1*d* from being damaged.

In the above described embodiments, the pressure contact type connector 1 may be a single body. However, for example, as shown in FIGS. 12A and 12B, the periphery of the pressure contact type connector 1 may be covered by a protective cover 7. Since the protective cover 7 is provided, when a finger unintentionally comes into contact with the pressure contact type connector, the force in the horizontal direction is not easily transmitted to the first spring portion 1*c* and the second spring portion 1*d*, and it is possible to prevent the pressure contact type connector 1 from being damaged. In addition, since the protective cover 7 is guided along the outline of the pressure contact type connector 1, the protective cover is not easily inclined and easily moves in the vertical direction.

It should be understood by those skilled in the art that various modifications, combinations, sub-combinations and alterations may occur depending on design requirements and other factors insofar as they are within the scope of the appended claims of the equivalents thereof.

The embodiments of the present inventions are not to be limited in scope by the specific embodiments described herein. Further, although some of the embodiments of the present disclosure have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A pressure contact type connector, comprising:

an upper flat plate portion which extends in a flat plate shape along a horizontal direction;

a lower flat plate portion which extends in a flat plate shape along a horizontal direction and is disposed below the upper flat plate portion;

a first spring portion which connects one end portion of the upper flat plate portion and one end portion of the lower flat plate portion and has elasticity in a vertical direction; and a second spring portion which is connected to at least one of the other end portion of the upper flat plate portion opposing the one end portion of the upper flat plate portion while interposing the upper flat plate portion and the other end portion of the lower flat plate portion opposing the one end portion of the lower flat plate portion while interposing the lower flat plate portion, extends toward the other ends of the upper flat plate portion and the lower flat plate portion, includes elasticity in the vertical direction, and is configured to apply a resilient force to the upper flat plate portion, wherein the first spring portion and the second spring portion are wound in the same direction about the upper flat plate portion when viewed from above in a plan view, and extend so that the first spring portion and the second spring portion do not interfere with each other when the spring portions are compressed and extended in the vertical direction, wherein the first spring portion is formed so as to be bent with respect to the upper flat plate portion and the lower flat plate portion so that a width dimension in the vertical direction is larger than a thickness dimension in the horizontal direction, and wherein the second spring portion is formed so as to be bent with respect to at least one of the upper flat plate portion and the lower flat plate portion so that a width dimension in the vertical direction is larger than a thickness dimension in the horizontal direction.

2. The pressure contact type connector according to claim 1, wherein the upper flat plate portion is formed by bending an upper plate portion of a metal plate having an L-shaped portion, which includes the upper plate portion extending along the vertical direction and an intermediate plate portion connected to the lower side of the upper plate portion and extending in one direction in the horizontal direction, so as to extend along the other direction which is the horizontal direction and is orthogonal to the one direction, and wherein the first spring portion or the second spring portion is formed by bending the intermediate plate portion so as to be wound around a virtual center line which is set along the vertical direction.

3. The pressure contact type connector according to claim 1, wherein the lower flat plate portion is formed by bending a lower plate portion of a metal plate having an L-shaped portion, which includes the lower plate portion extending along the vertical direction and an intermediate plate portion connected to the upper side of the lower plate portion and extending in one direction in the horizontal direction, so as to extend along the other direction which is the horizontal direction and is orthogonal to the one direction, and wherein the first spring portion or the second spring portion is formed by bending the intermediate plate portion so as to be wound around a virtual center line which is set along the vertical direction.

4. The pressure contact type connector according to claim 1, wherein the first spring portion protrudes upward from the one end portion of the lower flat plate portion and is bent so as to be wound at the upper side of the lower flat plate portion, and wherein the second spring portion protrudes from one of the other end portion of the upper flat plate portion and the other end portion of the lower flat plate portion toward the other, and is bent so as to be wound at the upper side of the lower flat plate portion.

5. The pressure contact type connector according to claim 1, wherein a stopper portion, which is formed to protrude upward at a location of noninterference with the first spring portion and the second spring portion, is connected to the lower flat plate portion.

6. The pressure contact type connector according to claim 5, wherein a height dimension of the stopper portion is equal to or more than a height dimension of a base portion of each of the first spring portion and the second spring portion connected to the lower flat plate portion.

7. The pressure contact type connector according to claim 5, wherein the stopper portion is provided outside the first spring portion and the second spring portion.

8. The pressure contact type connector according to claim 1, wherein the width dimensions in the vertical direction of the first spring portion and the second spring portion decrease from the lower side toward the upper side in the entirety thereof.

9. The pressure contact type connector according to claim 1, wherein the second spring portion is connected to the other end portion of the lower flat plate portion, and wherein an auxiliary upper flat plate portion extending from the second spring portion is provided on the lower side of the upper flat plate portion.

10. The pressure contact type connector according to claim 9, wherein the upper flat plate portion and the auxiliary upper flat plate portion are disposed so as to be separated from each other in the vertical direction in a contactable manner.

11. A pressure contact type connector, comprising:

an upper flat plate portion which extends in a flat plate shape along a horizontal direction;

a lower flat plate portion which extends in a flat plate shape along a horizontal direction and is disposed below the upper flat plate portion;

a first spring portion which connects the upper flat plate portion and the lower flat plate portion and has elasticity in a vertical direction; and a second spring portion which is connected to at least one of the upper flat plate portion and the lower flat plate portion, extends toward the other ends of the upper flat plate portion and the lower flat plate portion, includes elasticity in the vertical direction, and is configured to apply a resilient force to the upper flat plate portion, wherein the first spring portion and the second spring portion extend so as to be wound in the same direction about the upper flat plate portion when viewed from above in a plan view, wherein the first spring portion is formed so as to be bent with respect to the upper flat plate portion and the lower flat plate portion so that a width dimension in the vertical direction is larger than a thickness dimension in the horizontal direction, and wherein the second spring portion is formed so as to be bent with respect to at least one of the upper flat plate portion and the lower flat plate portion so that a width dimension in the vertical direction is larger than a thickness dimension in the horizontal direction.

12. The pressure contact type connector according to claim 11, wherein the first spring portion and the second spring portion are provided so that the spring portions are wound in the same direction in a state where the plate surfaces of the spring portions at least partially oppose each other.

* * * * *